US008789825B2

(12) United States Patent
Li et al.

(10) Patent No.: US 8,789,825 B2
(45) Date of Patent: Jul. 29, 2014

(54) CLAMPING MECHANISM WITH CAMMED DRIVING LINKAGE

(75) Inventors: Bing Li, Shenzhen (CN); Bo Yang, Shenzhen (CN); Yong Zhang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 201 days.

(21) Appl. No.: 13/471,621

(22) Filed: May 15, 2012

(65) Prior Publication Data

US 2013/0082428 A1 Apr. 4, 2013

(30) Foreign Application Priority Data

Sep. 30, 2011 (CN) ..... 2011 1 0296637

(51) Int. Cl.
*B25B 1/06* (2006.01)

(52) U.S. Cl.
USPC ..... 269/218; 269/153; 269/216; 269/228; 269/240

(58) Field of Classification Search
USPC ..... 269/153, 216, 218, 228, 240
See application file for complete search history.

(56) References Cited

U.S. PATENT DOCUMENTS

| | | | | |
|---|---|---|---|---|
| 3,595,594 | A * | 7/1971 | Aronson | 279/117 |
| 2010/0013137 | A1* | 1/2010 | Weller | 269/218 |
| 2014/0048995 | A1* | 2/2014 | Li et al. | 269/153 |

* cited by examiner

*Primary Examiner* — Lee D Wilson
*Assistant Examiner* — Shantese McDonald
(74) *Attorney, Agent, or Firm* — Novak Druce Connolly Bove + Quigg LLP

(57) ABSTRACT

An exemplary clamping mechanism includes a mounting base, a clamping assembly and a driving assembly. The clamping assembly includes a rotating member rotatably assembled to the mounting base, drive pins, a guiding member, sliding members, and clamping members. The guiding member is mounted on the mounting base and defines guide slots. The sliding members are slidably engaged into the guide slots of the guiding member, and connected to the rotating member via the drive pins. The clamping members are assembled to distal ends of the sliding members, respectively. The driving assembly is mounted on the mounting base and connected to the rotating member thereby driving the rotating member to reciprocate to clamp or release a workpiece.

14 Claims, 3 Drawing Sheets

CLAMPING MECHANISM WITH CAMMED DRIVING LINKAGE

BACKGROUND

1. Technical Field

The present disclosure generally relates to clamping mechanisms, and particularly, to a clamping mechanism for securely holding a workpiece.

2. Description of Related Art

Clamping mechanisms are used in many fields of endeavor, including for example machining processes. A commonly used clamping mechanism generally includes a plurality of clamping members, and a plurality of driving cylinders respectively assembled with the corresponding clamping members. The clamping members are respectively driven by the driving cylinders to move, thereby cooperatively clamping a workpiece during a machining process. However, in the machining process, since the clamping members are respectively driven by the corresponding driving cylinders to work, a synchrony of the clamping mechanism is low, and thus, the clamping member has low stability. In addition, the plural cylinders mean the clamping mechanism has a complicated structure and a high cost.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure.

DETAILED DESCRIPTION

Figure 1:
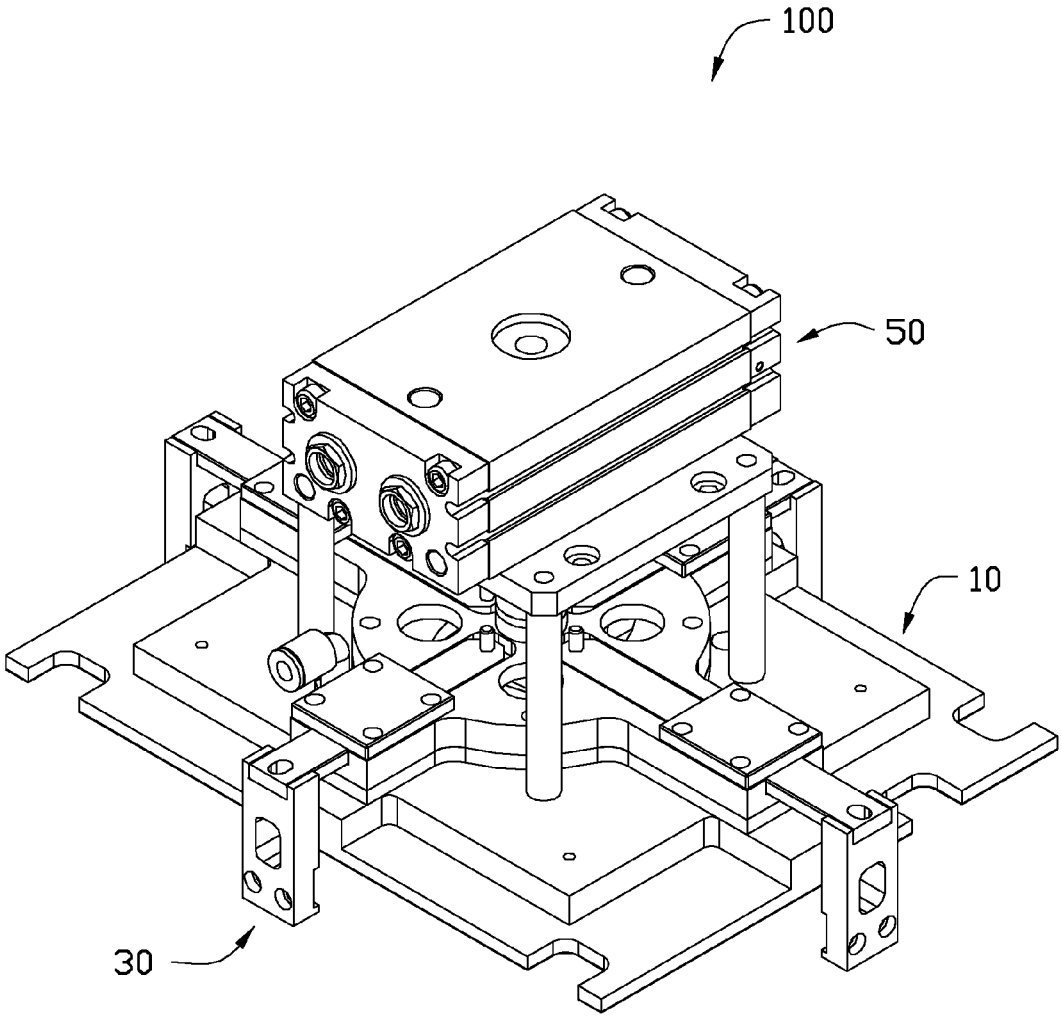
FIG. 1 shows an assembled isometric view of an embodiment of a clamping mechanism, wherein, the clamping mechanism includes a mounting base, a clamping assembly, and a driving assembly.

FIG. 1 shows a clamping mechanism 100. The clamping mechanism 100 includes a mounting base 10, a clamping assembly 30 mounted on the mounting base 10, and a driving assembly 50. The driving assembly 50 is mounted on the mounting base 10 and assembled with the clamping assembly 30, for driving the clamping assembly 30 to reciprocate thereby clamping or releasing a workpiece (not shown).

Figure 2:
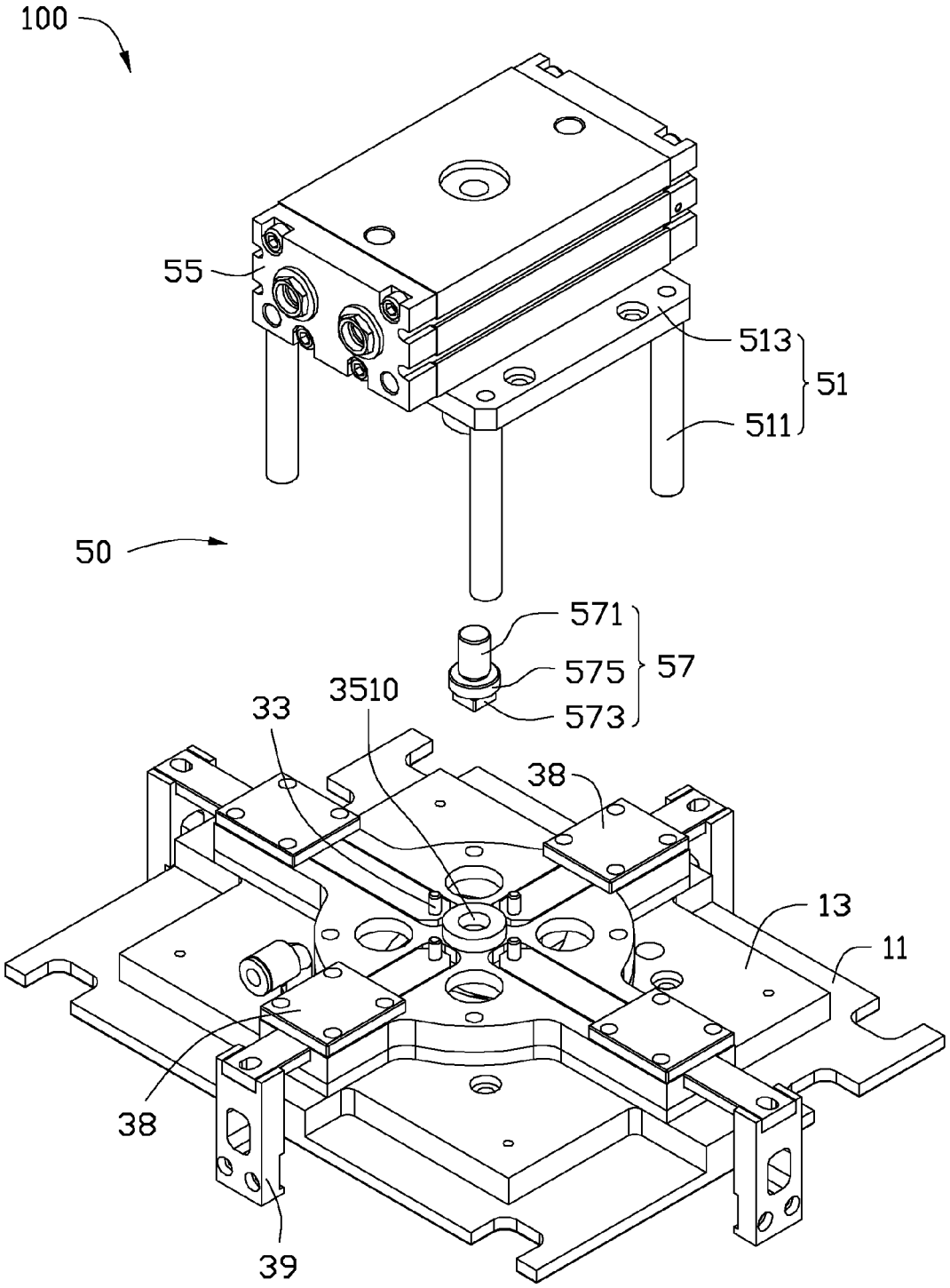
FIG. 2 shows an exploded view of the clamping mechanism of FIG. 1.
Figure 3:
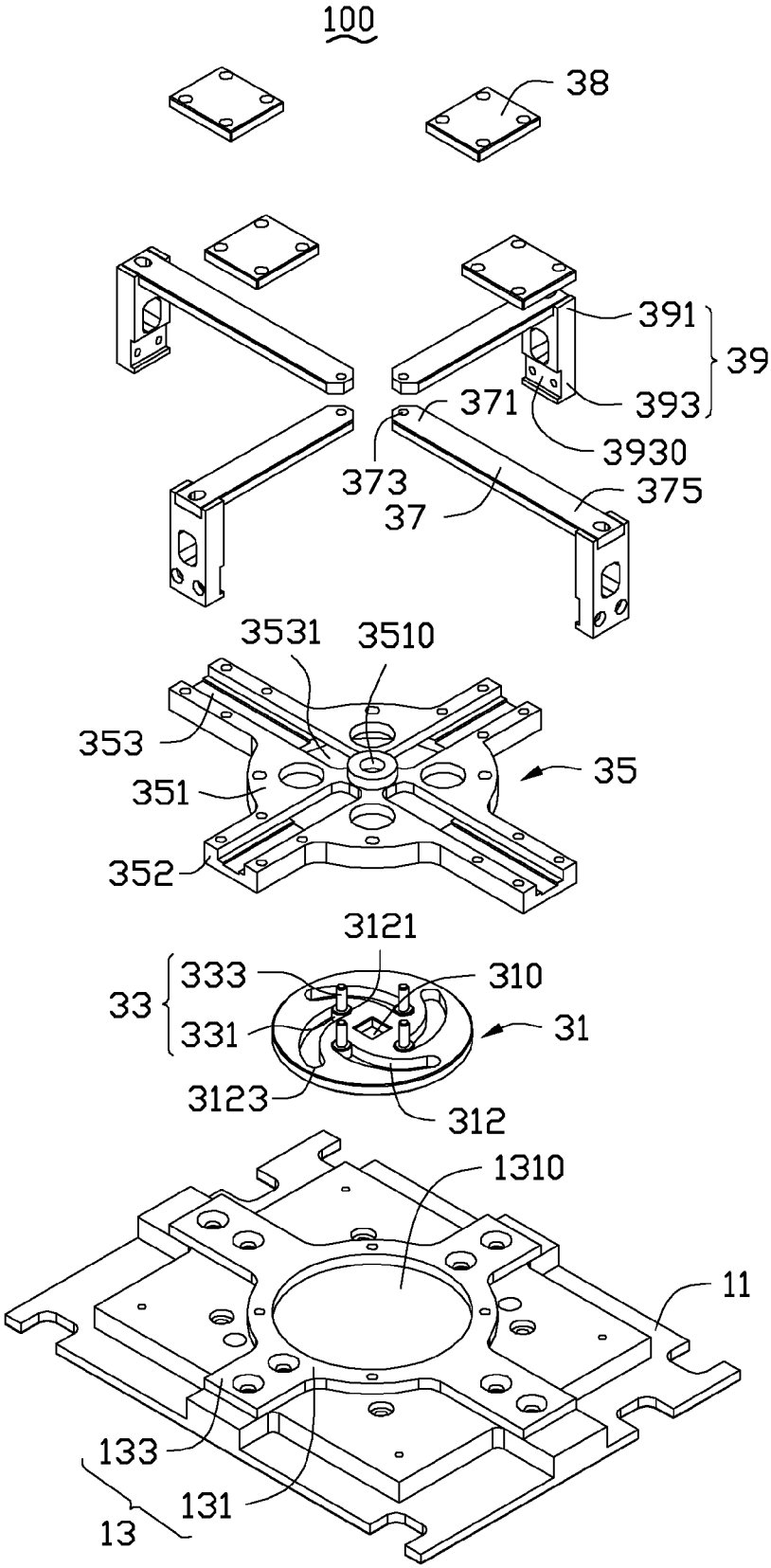
FIG. 3 shows an exploded view of the mounting base and the clamping assembly of FIG. 2.

Referring also to FIGS. 2 and 3, the mounting base 10 includes a substantially rectangular base body 11 and a support member 13 securely mounted on the base body 11. The support member 13 includes a substantially circular board shaped receiving portion 131, and four support portions 133. A substantially circular receiving hole 1310 is defined in a substantially central portion of a top surface of the receiving portion 131, away from the base body 11. The four support portions 133 are substantially bar-shaped, and symmetrically extend from a periphery of the receiving portion 131. In particular, two of the support portions 133 are symmetrically opposite each other, and the other two support portions 133 are symmetrically opposite each other. The number of support portions 133 is not limited to four, and can be two, three, or more than four according to actual needs. The support portions 133 are evenly angularly disposed on the periphery of the receiving portion 131, thereby circumferentially surrounding the receiving portion 131.

The clamping assembly 30 includes a rotating member 31, four drive pins 33, a guiding member 35, four sliding members 37, four stopping blocks 38, and four clamping members 39. In the illustrated embodiment, the rotating member 31 is a substantially circular disk, and is rotatably received in the receiving hole 1310 of the receiving portion 131 of the support member 13. A non-circular fastening hole 310 is defined through a substantially central portion of the rotating member 31. Four arc-shaped cam slots 312 are radially symmetrically defined in a top surface of the rotating member 31, away from the support member 13, and surround the fastening hole 310. More particularly, the cam slots 312 are rotationally symmetrically defined in the top surface of the rotating member 31. Each cam slot 312 includes a first end portion 3121 positioned adjacent to the central fastening hole 310; and an opposite second end portion 3123 positioned adjacent to a periphery of the rotating member 31, away from the corresponding fastening hole 310. A radial angle defined by two ends of each cam slot 312, relative to the central fastening hole 310 of the rotating member 31, is about 90 degrees.

Each drive pin 33 includes a bottom engaging end 331 and an opposite top connecting end 333. The four drive pins 33 are slidably assembled to the rotating member 31, with the engaging end 331 of each drive pin 33 slidably engaging in one corresponding cam slot 312. Thereby, the four drive pins 33 are capable of sliding relative to the rotating member 31 along the routes formed by the four corresponding cam slots 312. In particular, the engaging end 331 of each drive pin 33 is capable of rotating and sliding within the corresponding cam slot 312.

The guiding member 35 has substantially the shape same as the support member 13. The guiding member 35 is securely mounted on the support member 13, and receives the drive pins 33 therethrough. The guiding member 35 includes a substantially circular board shaped main body 351, and four guiding arms 352 symmetrically extending from a periphery of the main body 351. In particular, two of the guiding arms 352 are symmetrically opposite each other, and the other two guiding arms 352 are symmetrically opposite each other. The main body 351 defines a central shaft hole 3510 through a substantially central portion of the main body 351, corresponding to the fastening hole 310. Four guide slots 353 are symmetrically defined in a top surface of the guiding member 35. Each guide slot 353 extends from a position adjacent to the central shaft hole 3510 to a distal end of one corresponding guiding arm 352, along a radial direction of the central shaft hole 3510. A first end 3531 of each guide slot 353 adjacent to the central shaft hole 3510 is further defined through the main body 351, for allowing one corresponding drive pin 33 to pass therethrough. The number of guiding arms 352 is not limited to four. That is, the number of guiding arms 352 can instead be two, three, or more than four, corresponding to the selected number of support portions 133 of the support member 13.

The four sliding members 37 are all bar-shaped, and are slidably received in the four guide slots 353, respectively. Each sliding member 37 includes a first assembling end 371 and an opposite second assembling end 375. The first assembling end 371 defines a connecting hole 373, corresponding to the connecting end 333 of a respective one of the drive pins 33.

The four stopping blocks 38 are respectively fixed to distal ends of the four guiding arms 352, to prevent the four sliding members 37 from disengaging from the corresponding four guide slots 353.

The four clamping members 39 are respectively mounted to the second assembling ends 375 of the four sliding members 37. Each clamping member 39 is oriented along a direction substantially perpendicular to the corresponding sliding member 37. Each clamping member 39 includes a mounting end 391 fastened to the corresponding second assembling end 375, and an opposite clamping end 393 for clamping a workpiece. In the illustrated embodiment, the clamping end 393 defines a clamping slot 3930.

The number of sliding members 37, stopping blocks 38 and clamping members 39 are not limited to four. That is, the number of sliding members 37, stopping blocks 38 and clamping members 39 can instead be two, three, or more than four, corresponding to the selected number of guiding arms 35.

The driving assembly 50 includes a support bracket 51, a driver 55, and a driving shaft 57. The support bracket 51 includes a support board 511, and four support posts 513 symmetrically fastened to four corners of the support board 511 thereby supporting the support board 511. The four support posts 513 are fixed onto the support member 13. The driver 55 is mounted on the support board 511, and is further connected with the rotating member 31 via the driving shaft 57, for driving the rotating member 31 to rotate. In the illustrated embodiment, the driver 55 is a rotating cylinder. The driving shaft 57 includes a connecting shaft portion 571, a fixing shaft portion 573, and a flange portion 575 coaxially positioned between the connecting shaft portion 571 and the fixing shaft portion 573. The connecting shaft portion 571 is substantially cylindrical, and has a diameter substantially the same as a diameter of the central shaft hole 3510. Thus, the connecting shaft portion 571 passes through the central shaft hole 3510 and is attached to the driver 55. The fastening shaft portion 573 is non-circular, so that it can be securely engaged in the fastening hole 310. Thereby, the rotating member 31 is capable of being driven to rotate by the driver 55.

When assembling the clamping mechanism 100, first, the rotating member 31 together with the four drive pins 33 is received in the receiving hole 1310. The fastening shaft portion 573 is then securely engaged in the fastening hole 310. After that, the guiding member 35 is mounted on the support member 13, and sleeved on the connecting shaft portion 571. The connecting ends 333 of the four drive pins 33 pass through the corresponding first ends 3531 of the four guide slots 353, respectively. The four sliding members 37 are slidably attached to the guiding member 35 via the four stopping blocks 38 respectively, and are thus received in the corresponding four guide slots 353. The first assembling end 371 of each sliding member 37 is sleeved on and thus connected to the connecting end 333 of one corresponding drive pin 33. The four clamping members 39 are respectively mounted to the second assembling ends 375 of the four sliding members 37. Finally, the support bracket 51 is securely mounted on the support member 13, and the driver 55 is mounted on the support board 511 and connected with the connecting shaft portion 571. Thus, the assembly of the clamping mechanism 100 is finished.

In use of the clamping mechanism 100, the driver 55 drives the driving shaft 57 together with the rotating member 31 to rotate within a range of approximately 90 degrees in the illustrated embodiment, in a clockwise direction or a counterclockwise direction as required. When the rotating member 31 rotates, the four drive pins 33 are driven to slide within the four cam slots 312 back or forth correspondingly. The four sliding members 37 are correspondingly driven to slide radially along the four guide slots 353 back or forth, to clamp or release a workpiece.

The clamping mechanism 100 has a simple structure with optimum clamping performance. Since the four clamping members 39 together with the four sliding members 37 and the guiding member 35 are mounted to the rotating member 31 in the manner described above, the rotating member 31 need only be driven by the one driver 55; and the four clamping members 39 are driven to move simultaneously for clamping or releasing the workpiece. A synchrony and a stability of the clamping mechanism 100 are both enhanced. In addition, the clamping mechanism 100 can have a lower manufacturing cost.

In alternative embodiments, the support member 13 may be omitted. In such case, the receiving hole 1310 can be defined in the base body 11 directly. The radial angle defined by two ends of each cam slot 312, relative to the central fastening hole 310, is not limited to about 90 degrees. The radial angle can instead be about 30 degrees, 60 degrees, or 120 degrees, for example, according to actual needs. The stopping blocks 38 may be omitted. In such case, the sliding members 37 and the guide slots 353 may be formed with substantially wedge-shaped longitudinal cross-sections.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A clamping mechanism, comprising:

a mounting base;

a clamping assembly mounted on the mounting base for clamping or releasing a workpiece, the clamping assembly comprising:

a rotating member rotatably attached to the mounting base, the rotating member defining at least two cam slots;

at least two drive pins slidably engaged in the at least two cam slots of the rotating member, respectively;

a guiding member mounted on the mounting base above the rotating member, the guiding member defining a central shaft hole and at least two radial guide slots around the shaft hole, the at least two drive pins passing through the at least two guide slots, respectively;

at least two sliding members slidably engaged in the at least two guide slots of the guiding member, respectively, each sliding member comprising a first assembling end connected to one corresponding drive pin, and an opposite second assembling end positioned away from the shaft hole; and at least two clamping members attached to the second assembling ends of the at least two sliding members, respectively; and a driving assembly mounted on the mounting base, and comprising a driver having a driving shaft, the driving shaft passing through the shaft hole of the guiding member and fixed to the rotating member;

wherein, the rotating member is driven by the driver via the driving shaft to rotate clockwise or counterclockwise, thereby driving the at least two drive pins to slide along the at least two cam slots back or forth, and accordingly the at least two clamping members together with the at least two sliding members are driven to slide relative to the guiding member back or forth for clamping or releasing the workpiece.

2. The clamping mechanism of claim 1, wherein the mounting base defines a receiving hole, and the rotating member is a substantially circular disk, and is rotatably received in the receiving hole of the mounting base; and each cam slot is substantially arc-shaped and has a first end portion positioned adjacent to a central portion of the rotating member, and an opposite second end portion positioned adjacent to a periphery of the rotating member.

3. The clamping mechanism of claim 2, wherein a radial angle formed by two ends of each cam slot, relative to the central portion of the rotating member, is about 90 degrees.

4. The clamping mechanism of claim 2, wherein the guiding member comprises a main body and at least two guiding arms radially extending from a periphery of the main body and being evenly angularly spaced from each other, the at least two guide slots are respectively defined in the at least two guiding arms of the guiding member, the shaft hole is define through a central portion of the main body, and each guide slot extends from a position adjacent to the central shaft hole to a distal end of one corresponding guiding arm.

5. The clamping mechanism of claim 4, wherein a first end of each guide slot adjacent to the central shaft hole is further defined through the main body, and each drive pin passes through the first end of the corresponding guide slot.

6. The clamping mechanism of claim 4, wherein the clamping assembly further comprises at least two stopping blocks, and the at least two stopping blocks are respectively fixed to distal ends of the at least two guiding arms to prevent the at least two sliding members from disengaging from the corresponding at least two guide slots of the guiding member.

7. The clamping mechanism of claim 1, wherein each clamping member is perpendicularly mounted to the second assembling end of one corresponding sliding member, and defines a clamping slot.

8. The clamping mechanism of claim 7, wherein the driving assembly further comprises a support bracket mounted above the mounting base, and the driver is mounted on the support bracket.

9. A clamping mechanism, comprising:

a mounting base defining a receiving hole in a top surface thereof;

a rotating member rotatably received in the receiving hole of the mounting base, the rotating member defining a central fastening hole and four cam slots surrounding the fastening hole, symmetrically;

four drive pins slidably engaged in the four cam slots of the rotating member, respectively;

a guiding member mounted on the mounting base above the rotating member, the guiding member comprising a substantially circular main body and four guiding arms radially extending from a periphery of the main body and equally angularly spaced from each other, the main body defining a central shaft hole corresponding to the fastening hole of the rotating member, each guiding arm defining a longitudinal guide slot, and the four drive pins passing through the four guide slots of the guiding member, respectively;

four sliding members slidably engaged in the four guide slots of the guiding member, respectively, a first end of each sliding member connected to one corresponding drive pin;

four clamping members, each clamping member attached to an opposite second end of a respective sliding member; and a driver mounted on the mounting base, and connected to the rotating member via a driving shaft, the driving shaft passing through the shaft hole of the guiding member and fixed in the fastening hole of rotating member;

wherein, the rotating member is driven by the driver via the driving shaft to rotate clockwise or counterclockwise, thereby driving the drive pins to slide in the cam slots back or forth, and accordingly the clamping members together with the sliding members are driven to slide relative to the guiding member back or forth for clamping or releasing a workpiece.

10. The clamping mechanism of claim 9, wherein the mounting base comprises a base body and a support member securely mounted on the base body, the receiving hole is defined in a top surface of a substantially central portion of the support member; each cam slot is substantially arc-shaped and has a first end portion positioned adjacent to the central fastening hole of the rotating member, and an opposite second end portion positioned adjacent to a periphery of the rotating member.

11. The clamping mechanism of claim 10, wherein a radial angle formed by two ends of each cam slot, relative to the central portion of the rotating member is about 90 degrees.

12. The clamping mechanism of claim 10, wherein a first end of each guide slot adjacent to the central shaft hole is defined through the main body, the drive pin passes through the first end of the guide slot and fixed to the first assembling end of one corresponding sliding member.

13. The clamping mechanism of claim 9, wherein the clamping assembly further comprises four stopping blocks, the four stopping blocks are respectively fixed to distal ends of the four guiding arms, to prevent the four sliding members disengaging from the corresponding four guide slots of the guiding member.

14. The clamping mechanism of claim 9, wherein each clamping member is perpendicularly mounted to the second assembling end of one corresponding sliding member, and defines a clamping slot.

* * * * *